United States Patent [19]

Salkind

[11] Patent Number: 4,883,268

[45] Date of Patent: Nov. 28, 1989

[54] COMPACT, PORTABLE, ROWING TYPE EXERCISE APPARATUS USABLE BY A CHAIR-SEATED EXERCISER

[75] Inventor: Harry Salkind, Dallas, Tex.

[73] Assignee: McCabe-White Investment Corporation, Dallas, Tex.

[21] Appl. No.: 336,835

[22] Filed: Apr. 12, 1989

[51] Int. Cl.[4] ..... A63B 69/06

[52] U.S. Cl. ..... 272/73; 272/130; 280/304.1

[58] Field of Search ..... 272/72, 73, 130; 280/304.1; 128/25 R

[56] References Cited

U.S. PATENT DOCUMENTS

| | | | |
|---|---|---|---|
| D. 230,613 | 3/1974 | Coker et al. | D34/5 K |
| 3,754,547 | 8/1973 | Walker | 128/25 |
| 4,275,882 | 6/1981 | Grosser et al. | 272/117 |
| 4,354,676 | 10/1982 | Ariel | 272/129 |
| 4,373,716 | 2/1983 | Pagani | 272/73 |
| 4,397,462 | 8/1983 | Wilmarth | 272/130 |
| 4,402,502 | 9/1983 | Peters | 272/73 |
| 4,465,274 | 8/1984 | Davenport | 272/130 |
| 4,602,780 | 7/1986 | Gall | 272/72 |
| 4,606,538 | 8/1986 | Wang | 272/72 |
| 4,618,140 | 10/1986 | Brown | 272/72 |
| 4,736,944 | 4/1988 | Johnson et al. | 272/72 |
| 4,747,595 | 5/1988 | Mabry et al. | 272/118 |

FOREIGN PATENT DOCUMENTS

| | | | |
|---|---|---|---|
| 1024084 | 6/1983 | U.S.S.R. | 272/72 |
| 376851 | 7/1932 | United Kingdom | 272/72 |

OTHER PUBLICATIONS

Tunturi Catalog, 1979, p. 8, Home Rowing Machine.

*Primary Examiner*—Richard J. Apley
*Assistant Examiner*—Franklin L. Gubernick
*Attorney, Agent, or Firm*—Hubbard, Thurman, Turner & Tucker

[57] ABSTRACT

A rowing type exercise device which is conveniently usable by an exerciser seated in a wheelchair, or other chair-like structure, includes an elongated base structure having a floor supported use orientation in which its rear end extends rearwardly beneath the wheelchair. A force input lever is pivotally secured to a longitudinally intermediate portion of the base structure, and the outer end of the lever is provided with handgrips which may be grasped by the chair-seated exerciser to pivot the lever forwardly and rearwardly in a rowing motion which is resisted, in both directions, by an elongated piston and cylinder unit interconnected at its opposite ends to the lever and a front end of the device. The piston and cylinder unit connection location on the lever may be adjusted to selectively vary the lever resistance force. During use of the device, the user's feet are comfortably supported on longitudinally adjustable foot rest members connected to the base structure forwardly of the lever. A counterweight member is secured to a rear portion of the base structure to inhibit forward and upward tipping thereof during forward rowing motion of the lever. A pair of support wheels are secured to the front end of the device and engage the floor when a carrying handle on the rear end of the device is lifted, thereby conveniently permitting the device to be easily rolled to and from a storage location.

14 Claims, 2 Drawing Sheets

COMPACT, PORTABLE, ROWING TYPE EXERCISE APPARATUS USABLE BY A CHAIR-SEATED EXERCISER

BACKGROUND OF THE INVENTION

The present invention relates generally to exercise apparatus and, in a preferred embodiment thereof, more particularly provides a compact, portable, rowing type exercise device conveniently usable by an exerciser sitting, for example, in a wheelchair, an ordinary chair, a couch, a bench or the like.

It is well known that rowing type exercising machines of various conventional types provide excellent sources of overall body toning and cardiovascular conditioning. However, conventional rowing machines are difficult if not impossible to use by wheelchair-confined exercisers.

Some attempts have been made to modify large "gym type" rowing machines so that they can be operated by wheelchair exercisers. The modification typically entails the provision of a specially designed and positioned seat onto which the exerciser must be lifted from his wheelchair seat. The use of this type of converted machine is particularly inconvenient for the wheelchair exerciser—requiring both a trip to the gym and a helper to lift the exerciser onto the machine seat and then back onto the wheelchair seat.

Smaller "home type" rowing machines of conventional construction, while eliminating trips to a gym, are also ill suited for use by wheelchair-confined exercisers. Rowing machines of this type are typically floor mounted and provided with a sliding seat structure positioned very close to the floor. Accordingly, to use a rowing machine of this type (if he can use it at all), the exerciser still needs a helper to move him from the wheelchair seat onto the rowing machine seat and back onto the wheelchair seat. As in the case of the larger, gym type rowing machines, this requirement is simply unacceptable to the large number of wheelchair users who strive for a high level of independence and self sufficiency.

The desire to exercise at home with rowing type machinery is, of course, not limited to wheelchair users. However, the typical home type rowing machine of conventional construction is typically quite bulky and rather heavy, thereby requiring fairly large areas for its use and storage, and considerable user strength to move it about. If either sufficient space or user strength is absent, the typical home type rowing machine is simply not a desirable adjunct to a home exercise program. This is particularly true if the exerciser (though not confined to a wheelchair) is elderly and/or lives in a small apartment.

In view of the foregoing, it is an object of the present invention to provide rowing type exercise apparatus which eliminates or minimizes the above-mentioned and other problems, limitations and disadvantages typically associated with rowing exercise machines of conventional construction.

SUMMARY OF THE INVENTION

In carrying out principles of the present invention, in accordance with a preferred embodiment thereof, a compact, portable rowing type exercise device is provided which is conveniently usable by an exerciser sitting, for example, in a wheelchair, an ordinary chair, a couch, a bench or the like.

In its preferred embodiment, the device comprises an elongated base structure having a front longitudinal portion with a generally T-shaped outer end, a longitudinally intermediate portion, and a rear longitudinal portion having a generally T-shaped outer end. The base structure has a use orientation in which it extends longitudinally along and is supported by the floor surface upon which the chair rests, with the rear longitudinal portion of the base structure extending rearwardly beneath the chair, and the balance of the base structure extending forwardly beyond the chair. To inhibit shifting of the base structure along the floor, rubber frictional gripping members are secured to the undersides of its front and rear ends.

An elongated, upstanding force input lever is connected at an inner end thereof to the longitudinally intermediate portion of the base structure for forward and rearward pivotal movement relative thereto about a horizontal axis generally transverse to the length of the base structure. The force input lever has an outer end portion to which a pair of hand grips are secured that may be grasped by an exerciser sitting in the chair and pushed and pulled to impart a rowing motion to the lever. This rowing motion is yieldingly resisted, in both forward and rearward directions, by an elongated piston and cylinder unit pivotally connected at its opposite ends to the front end of the base structure and the longitudinally intermediate portion of the force input lever. The lever end of the piston and cylinder unit is connected to the lever by means of a bracket which is slidable along the length of the lever and may be releasably secured to various locations thereon, by a spring loaded pin member removably receivable in a selected one of a spaced series of transverse holes formed in the lever, to thereby selectively adjust the rowing resistance force imposed on the lever by the piston and cylinder unit.

During use of the device, the chair-seated exerciser's feet are comfortably supported on a pair of foot rest members which are positioned on the base structure between its front end and its longitudinally intermediate portion, and which may be adjustably moved along the length of the base structure.

Counterweight means are secured to the rear longitudinal portion of the base structure and are operative to inhibit forward and upward tipping of the base structure during forward pivotal motion of its force input lever, and also serve to increase the frictional force upon the floor of the rear rubber gripping members to inhibit forward movement of the device along the floor during forward pivotal movement of the force input lever.

A pair of support wheels are secured to the front end of the device and, with the base structure in its use orientation, are spaced upwardly from the floor. When it is desired to move the device away from the chair to a storage location, a carrying handle secured to the rear end of the base structure is lifted to forwardly and upwardly tip the base structure away from its horizontal position. When the base structure is tipped upwardly to an angle of approximately 15°, the wheels engage the floor and permit the device to be easily rolled along the floor to and from a storage location.

DETAILED DESCRIPTION

Figure 1:
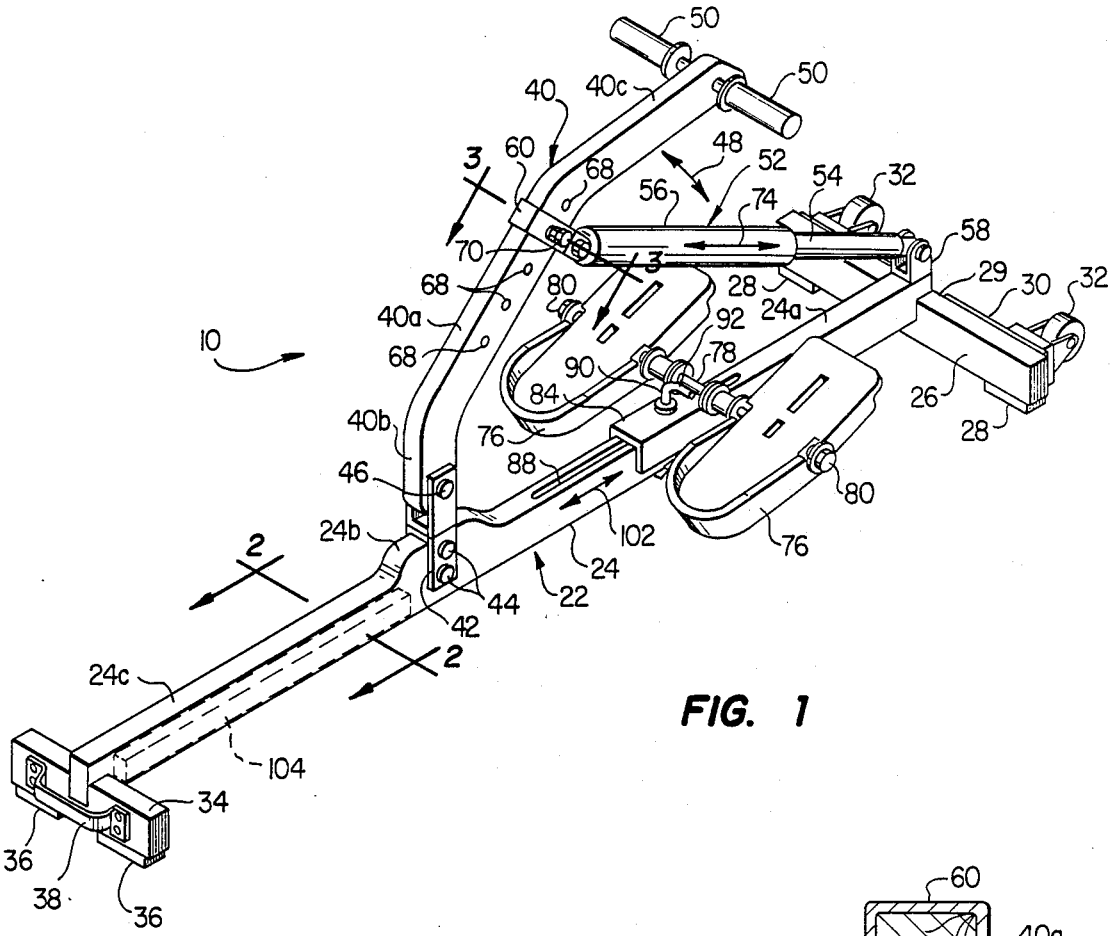
FIG. 1 is a perspective view of a compact, portable, rowing type exercise device which embodies principles of the present invention and is conveniently usable by a chair-seated exerciser.

Perspectively illustrated in FIG. 1 is a compact, portable rowing type exercise device 10 which is conveniently usable by an exerciser 12 (FIG. 5) seated in a wheelchair 14 having an elevated seat portion 16 supported by a pair of wheels 18 resting upon a floor 20. While the device 10 is particularly well suited for use by wheelchair exercisers, it is also quite suitable for use by exercisers seated in ordinary chairs or other chair-like structures such as couches, benches and the like.

The exercise device 10, as best illustrated in FIG. 1, comprises an elongated, floor supportable base structure 22 which includes an elongated central support member 24 having a generally rectangular cross-section along its length, a front longitudinal portion $24_a$, an upwardly enlarged longitudinally intermediate portion $24_b$, and a rear longitudinal portion $24_c$.

The front end of the base structure 22 has a generally T-shaped configuration defined by an elongated, horizontal front cross member 26 transversely secured at a longitudinally central portion thereof to the outer end of the front longitudinal portion $24_a$ of the central support member 24. For purposes later described, the undersides of the outer ends of the front cross member 26 have secured thereto a pair of rubber frictional gripping members 28. At its opposite ends, the front side surface 28 of the cross member 26 has secured thereto, by means of an elongated mounting bracket 30, are a pair of support wheels 32.

The rear end of the base structure 22 also has a generally T-shaped configuration defined by a horizontal rear cross member 34, somewhat shorter than the front cross member 26, which is transversely secured at a longitudinally central portion thereof to the outer end of the rear longitudinal portion $24_c$ of the central support member 24. The undersides of the opposite ends of the rear cross member 34 have secured thereto a pair of rubber frictional gripping members 36 and, for purposes later described, a rearwardly projecting carrying handle 38 is secured to the backside of the rear cross member 34.

The exerciser force input portion of the device 10 comprises an elongated force input lever member 40 having a longitudinally central portion $40_a$, a downwardly bent rear or inner end portion $40_b$, and a forwardly bent outer or front end portion $40_c$. The bottom leg portions of a vertically disposed, generally H-shaped mounting bracket 42 extend downwardly along opposite sides of the longitudinally intermediate portion $24_b$ of the central support member 24 and are anchored thereto by suitable fastening members such as bolts or screws 44. The inner end portion $40_b$ of the lever 40 is positioned between the upper legs of the bracket 42 and is pivotally secured thereto by a pivot pin 46 extending through the upper bracket legs and the inner lever end. This pivotally secures the lever 40 to the longitudinally intermediate portion $24_b$ of the central support member 24 for forward and rearward pivotal motion relative thereto, as indicated by the double-ended arrow 48 in FIG. 1, about a horizontal axis transverse to the length of the base structure 22. The outer end of the front longitudinal lever portion $40_c$ is provided with a pair of padded, transversely extending handgrip members 50 adapted to be grasped by the seated exerciser 12, and pushed and pulled to forwardly and rearwardly pivot the lever 40 in a rowing fashion.

Both the forward and rearward pivotal motion of the lever 40 relative to the base structure 22 are yieldingly resisted by an elongated piston and cylinder unit 52 having an elongated piston portion 54 telescoped within an elongated cylinder portion 56. In the illustrated preferred embodiment of the exercise device 10, the piston and cylinder unit 52 is an automotive shock absorber. The outer end of the piston portion 54 is pivotally secured to an upstanding bracket member 58 anchored to the outer end of the front longitudinal portion $24_a$ of the central support member 24. The pivotal connection of the piston portion 54 to the bracket 58 permits the piston and cylinder unit 52 to pivot relative to the base structure 22 about a horizontal axis parallel to the length of the front cross member 26.

Figure 3:
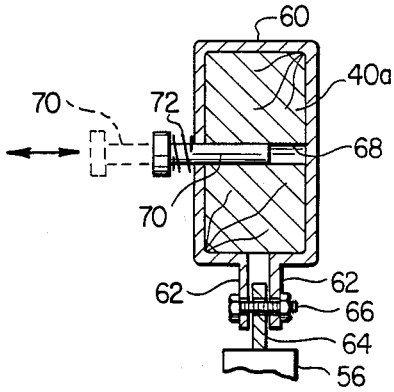
FIG. 3 is an enlarged scale cross-sectional view through the device taken along line 3—3 of FIG. 1.

Referring now to FIGS. 1 and 3, a generally rectangularly cross-sectioned hollow mounting bracket 60 is slidably mounted around the central portion $40_a$ of the lever 40 for movement along its length. The bracket 60, as best illustrated in FIG. 3, has a spaced apart pair of tab portions 62. The outer end of the cylinder portion 56 has a mounting eye 64 thereon which is positioned between the tabs 62 and is pivotally secured to the bracket 60 by means of a pivot pin member 66 extended through the tabs 62 and the eye 64.

To selectively vary the forward and rearward pivotal resistance force imposed on the lever 40 by the piston and cylinder unit 52, the bracket member 60 is adjustable along the length of the central lever portion $40_a$. As best illustrated in FIGS. 1 and 3, this adjustment of the bracket 60 relative to the central lever portion $40_a$ is achieved utilizing a longitudinally spaced series of transverse circular holes 68 formed through the side of the central lever portion $40_a$, and a spring-loaded detent pin 70 operatively carried on one side of the bracket 60 for entry into and removal from a selected one of the hole 68 as indicated by the solid and dotted line positions of the detent pin 70 in FIG. 3.

To reposition the bracket 60 along the length of the central lever portion $40_a$, and releasably lock the bracket 60 in its new position, the pin 70 is pulled outwardly from its solid line position in FIG. 3 to its dotted line position to remove the pin from the particular lever hole 68 in which it is received. Such pin removal permits the bracket 60, and thus the outer end of the cylinder portion 56, to be shifted upwardly or downwardly along the central lever portion $40_a$. When the pin 70 is brought into alignment with another one of the holes 68, it is released, and its associated tension spring 72 drives the pin 70 into its new lever hole 68 to again releasably lock the bracket 60 to the central lever portion $40_a$.

It can be seen that with the pin 70 positioned within the uppermost lever hole 68 the forward and rearward pivotal resistance force 74 imposed on the lever 40 by the piston and cylinder unit 52 is at a minimum thereof, while positioning the pin 70 in the lowermost lever hole 68 maximizes this forward and rearward pivotal resistance force 74.

Figure 4:
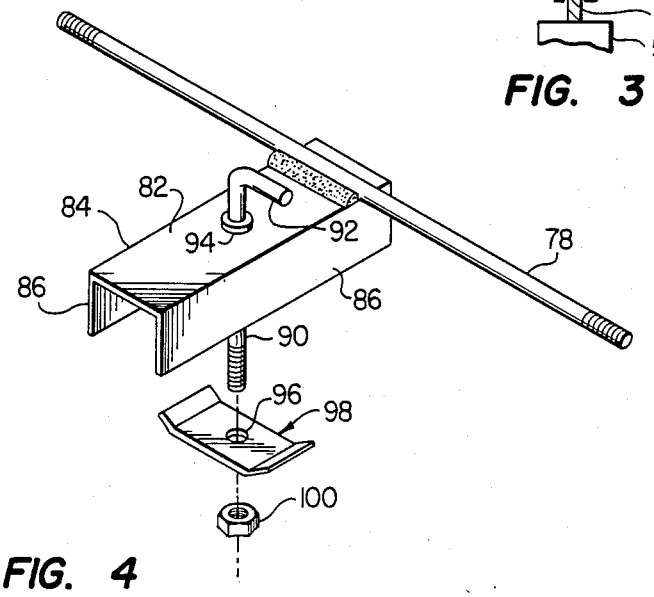
FIG. 4 is an enlarged scale exploded perspective view of an adjustable footrest support portion of the device.

Referring now to FIGS. 1 and 4, during exerciser use of the device 10 the exerciser's feet are comfortably supported on a pair of footrest members 76 positioned on opposite sides of the front central support member portion $24_a$ between its outer end and longitudinally intermediate portion $24_b$ of the base structure 22. The footrest members 76 are pivotally carried on opposite end portions of an elongated support rod 78 positioned above the central support member portion $24_a$ and extending transversely thereto, the footrest members being captively retained on the rod 78 by retaining nuts 80 threaded onto its outer ends. A central portion of the rod 78 is welded to the upper side wall 82 of a generally inverted U-shaped support bracket 84 having depending skirt wall portions 86. An upper side portion of the central support member 24 is upwardly received within the interior of the bracket 84, and the bracket 84 is slidable along the length of the central support member portion $24_a$ over an longitudinally elongated slot 88 laterally extending downwardly therethrough from its upper side surface to its lower side surface.

The bracket 84 may be releasably locked to the central support member 24, at a selected position along the length of the slot 88, by means of an elongated locking bolt member 90 having an angled upper end 92 positioned above the upper side wall 82 of the bracket 84. The bolt 90 extends downwardly through an opening 94 formed in the bracket wall 82, through the slot 88 and an opening 96 in a locking bracket 98 bearing against the underside of the central support member portion $24_a$, and is threaded into a retaining nut 100 positioned beneath the bracket 98.

By rotating the upper bolt end in a clockwise direction, the bolt 90 is tightened into the retaining nut 100 to thereby draw the brackets 84 and 98 into tight engagement with the central support member portion 28*a* and thereby lock the footrest member 76 against longitudinal movement relative to the central support member 24.

However, by loosening the bolt 90, the footrest members 76 may be moved forwardly or rearwardly relative to the central support member 24, and then re-locked in their longitudinally adjusted position simply by retightening the bolt 90. This provides a convenient exerciser leg length adjustment for the device 10.

Figure 2:
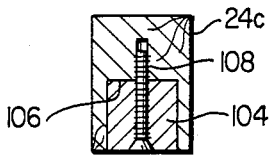
FIG. 2 is an enlarged scale cross-sectional view through the device taken along line 2—2 of FIG. 1.

For purposes later described, an elongated, rectangularly cross-sectioned metal counterweight member 104 (see FIGS. 1 and 2) is positioned within a correspondingly configured recess 106 extending upwardly through the underside of the central support member rear longitudinal portion $24_c$. The counterweight member 104 is held within the recess 106 by means of suitable fastening members such as screws 108.

In the illustrated preferred embodiment of the device 10, the base structure 22 and the force input lever 40 are of an attractive solid wood construction. However, it will be readily appreciated that, if desired, these portions of the device could alternately be formed from other suitably high strength materials such as plastic, fiberglass, or hollow metal elements.

Figure 5:
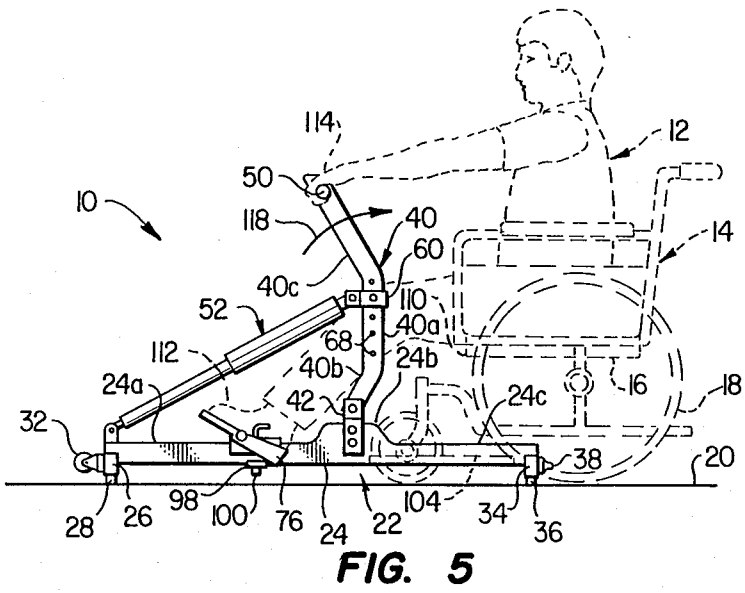
FIGS. 5 and 6 are reduced scale side elevational views of the device positioned in its floor supported use orientation and being operated by a wheelchair-seated exerciser, the exerciser and wheelchair being shown in phantom for purposes of illustrative clarity.
Figure 6:
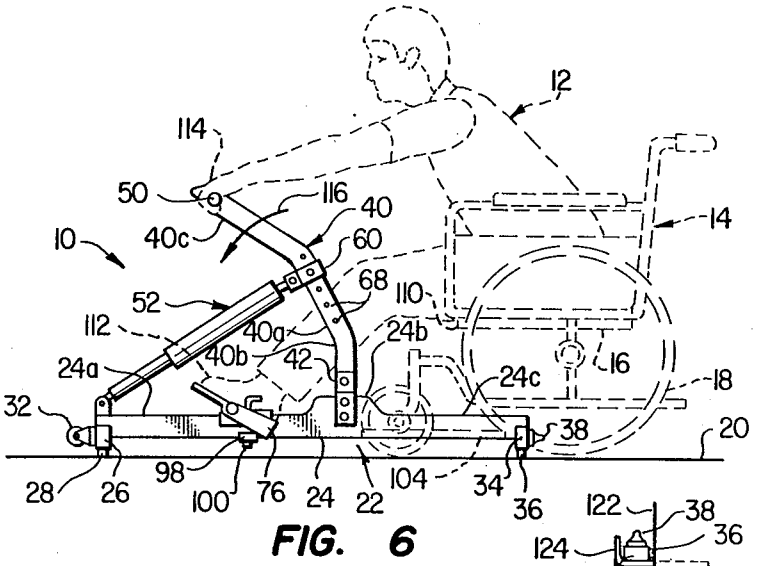

Turning now to FIGS. 5 and 6, it can be seen that the device 10 has a use orientation in which the base structure longitudinally extends parallel to the floor 20, and is supported thereon by its front and rear rubber gripping members 28 and 36, with the rear longitudinal portion $24_c$ of the central support member 24 extending rearwardly beneath the wheelchair seat 16 between wheels 18, and the balance of the base structure 22 extending forwardly beyond the front side edge 110 of the seat 16. As illustrated, the central support member 24 is positioned slightly above the floor 20 t provide floor clearance for the footrest locking bracket 98 and its associated retaining nut 100. With the base structure 22 in this use orientation, the front support wheels 32 are spaced upwardly apart from the floor 20.

With the footrest members 76 appropriately positioned along the length of the central support member portion $24_a$, and releasably locked thereto as previously described, the exerciser 12 places his feet 112 on the footrest members 76, and grasps the lever member handgrips 50 with his hands 114. The exerciser then forwardly and rearwardly pivots the lever 40, in a "rowing" fashion indicated by the arrows 116 and 118, against the previously described resistance force of the piston and cylinder unit 52. During this exerciser motion, which provides both body toning and cardiovascular conditioning benefits to the exerciser, the exerciser bends forwardly and rearwardly at the waist as may be seen by comparing FIGS. 5 and 6. To easily adjust the resistance to this rowing exerciser motion, the exerciser 12 simply repositions the bracket 60 along the length of the central bracket portion $40_a$.

During the forward portion 116 of this rowing exercise motion, the counterweight member 104 functions to inhibit forward and upward tipping of the base structure 22 about its front end. The counterweight member also serves to increase the frictional gripping force of the rear gripping members 36 upon the floor 20 to further inhibit forward sliding motion of the base structure 22 along the floor 20.

Figure 7:
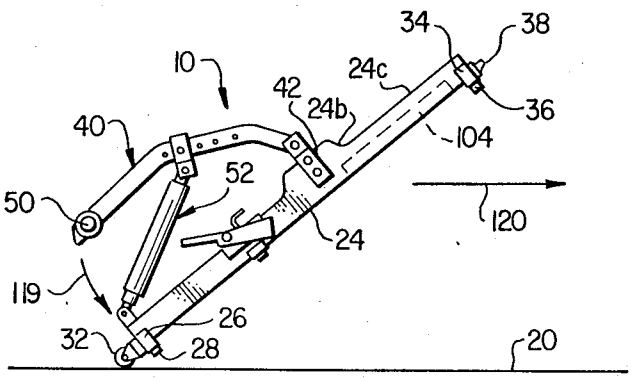
FIG. 7 is a reduced scale side elevational view of the device being rolled across the floor to or from its storage location.

When the exerciser 12 is finished with the device 10, he simply moves the wheelchair rearwardly and reaches down and grasps the rear carrying handle 38. He then pivots the central support member 24 upwardly and forwardly to bring the wheel members 32 into rolling engagement with the floor 20 as illustrated in FIG. 7. The wheel members 32 are vertically positioned on the front cross member 26 so that they are brought into engagement with the floor 20 when the central support member 24 is forwardly and upwardly pivoted at an angle of about 15° relative to the floor 20, at which point the front gripping members 28 are lifted off the floor. As illustrated by the arrows 119 in FIGS. 7 and 8, the lever member 40 can be forwardly and downwardly pivoted (from its position shown in FIG. 7) to a storage orientation in which its outer end is closely adjacent the outer end of the central support member 24, thereby positioning the device 10 in a very compact storage and transport configuration. With the wheels 32 operatively engaging the floor 20, the exerciser 12, while still in his wheelchair 14, simply rolls the device 10 rearwardly, as indicated by the arrow 120, to a suitable storage location.

Figure 8:
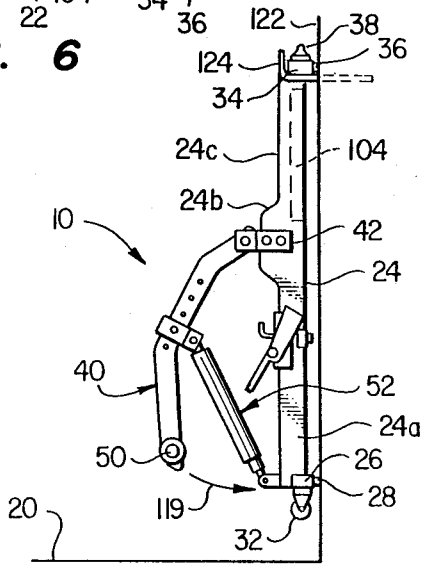
FIG. 8 is a reduced scale side elevational view of the device in a representative storage orientation thereof in which the device is hung, in a vertical position, on a wall.

The device 10, in its compact storage orientation, can simply be placed in a closet, propped up against a wall, or positioned horizontally on the floor in a small corner of a room. Alternatively, as illustrated in FIG. 8, the device 10 (in its compact storage orientation, or with the lever 40 in an intermediate position as shown in FIG. 8) can also be hung on a wall 122 using, for example, a pair of hook members 124 which engage the opposite ends of the rear cross member 34 and support the device 10 vertically along the wall 122 with the front support wheels 32 spaced upwardly apart from the floor 20.

When the exerciser 12 wants to use the device 10 again, he simply wheels his chair 14 over to the wall 122, lifts the device 10 off the hooks 124 and rolls the device 10 across the floor 20 to a desired exercise location. He then places the rear end of the device on the floor as depicted in FIG. 5, operatively positions the wheelchair 14 over the rear central support member portion $24_c$, and begins the rowing exercise.

The compactness and easy maneuverability of the exercise device 10 makes it particularly well suited to wheelchair exercisers and conveniently provides them with rowing type exercise apparatus which does not require the aid of a helper for its use. The device 10 is easy and relatively inexpensive to manufacture from very simple components.

While the unique construction and configuration of the device 10 renders it conveniently usable and independently transportable by wheelchair exercisers, it will be readily appreciated that the device is also well suited to exercisers sitting in other chair-like structures such as benches, couches, or ordinary chairs.

The foregoing detailed description is to be clearly understood as being given by way of illustration and example only, the spirit and scope of the present invention being limited solely by the appended claims.

What is claimed is:

1. Compact, portable, seatless rowing type exercise apparatus usable by an exerciser seated in a chair or the like having a pair of support portions resting upon a floor surface and disposed on opposite sides of an elevated seat, said exercise apparatus comprising:

an elongated base structure having a front longitudinal portion with an outer end, a longitudinally intermediate portion, and a rear longitudinal portion with an outer end, said rear longitudinal portion consisting essentially of an outer end portion, a handle means mounted on said outer end portion, an elongated connecting portion connecting said outer end portion to said longitudinally intermediate portion of said base structure and a counterweight means operatively connected to said elongated connecting portion, said base structure having a use orientation in which it longitudinally extends along and is supported by the floor surface, with said rear longitudinal portion extending rearwardly between the support portions of the chair beneath its seat, and the balance of said base structure extending forwardly beyond the chair along the floor surface;

an elongated, upstanding force input lever pivotally connected at an inner end thereof to said longitudinally intermediate portion of said base structure for forward and rearward pivotal movement relative thereto, in a generally rowing-like fashion, about a horizontal axis generally transverse to the length of said base structure, said force input lever having an outer end portion to which handgrip means are secured that may be grasped by an exerciser sitting in the chair and pushed and pulled to respectively impart said forward and rearward pivotal movement to said force input lever;

resistance means operatively connected between said base structure and said force input lever for yieldingly resisting both said forward pivotal movement and said rearward pivotal movement of said force input lever relative to said base structure;

footrest means, carried by said front longitudinal portion of said base structure between its outer end and said longitudinally intermediate portion of said base structure, for supporting the feet of the seated exerciser;

rolling support means, secured to said outer end of said front longitudinal portion of said base structure, for rollingly supporting said outer end of said front longitudinal portion on the floor surface when said base structure is forwardly and upwardly tipped, said rolling support means being spaced upwardly apart from the floor surface when said base structure is in its use orientation;

said handle means being associated with said outer end portion of said rear longitudinal portion of said base structure and liftable to forwardly and upwardly pivot said base structure to thereby operatively engage said rolling support means with the floor surface to permit said exercise apparatus to be easily rolled therealong to a storage location; and said counterweight means, being operatively connected to said rear longitudinal correcting portion of said base structure, for inhibiting forward and upward tipping of said base structure during forward pivotal motion of said force input lever relative to said base structure with said base structure in its use orientation.

2. The exercise apparatus of claim 1 wherein:

said resistance means include an elongated piston and cylinder unit having first and second opposite ends, first connection means for securing said first end of said piston and cylinder unit to said outer end of said front longitudinal portion of said base structure, and second connection means for securing said second end portion of said piston and cylinder unit to said force input lever.

3. The exercise apparatus of claim 2 wherein:

said piston and cylinder unit is an automotive shock absorber.

4. The exercise apparatus of claim 2 wherein:

said second connection means are movable along the length of said force input lever, and said exercise apparatus further comprises locking means for releasably locking said second connection means to selectively variable locations along the length of said force input lever to thereby selectively vary the pivotal resistance force imposed upon said force input lever by said piston and cylinder unit.

5. The exercise apparatus of claim 4 wherein:

said locking means include a spaced series of holes formed transversely through said force input lever, and a spring-loaded detent pin member carried by said second connection means and removably insertable into a selected one of said transverse holes in said lever member.

6. The exercise apparatus of claim 1 wherein:

said footrest means are movable along the length of said base structure, and said exercise apparatus further comprises locking means for releasably locking said footrest means to selectively variable portions of said base structure along its length.

7. The exercise apparatus of claim 6 wherein:

said front longitudinal portion of said base structure has an elongated slot formed therethrough and longitudinally extending parallel to the length of said front longitudinal portion of said base structure, and said footrest means and said locking means include a pair of footrest members pivotally secured to opposite end portions of an elongated rod member having a longitudinally central portion anchored to a first bracket member slidingly engaging an upper side of said front longitudinal portion of said base structure over said slot, a second bracket member slidably engaging the bottom side of said front longitudinal portion of said base structure, and a threaded bolt member extending downwardly through said first bracket member, said slot, and said second bracket member and having a lower end portion threadingly received in a retaining nut positioned against the underside of said second bracket member, said bolt member being turnable to selectively and releasably clamp said first and second bracket members to said front longitudinal portion of said base structure.

8. The exercise apparatus of claim 1 wherein:

said rolling support means include a spaced pair of support wheel members operatively secured to said outer end of said front longitudinal portion of said base structure.

9. The exercise apparatus of claim 1 wherein:

said rear longitudinal portion of said base structure has a recess formed therein, and said counterweight means comprise a counterweight member disposed within said recess.

10. Compact, portable seatless rowing type exercise apparatus usable by an exerciser seated in a chair or the like having a pair of support portions resting upon a floor surface and disposed on opposite sides of an elevated seat, said exercise apparatus comprising:

an elongated base structure having a front longitudinal portion with an outer end, a longitudinally intermediate portion, and a rear longitudinal portion with an outer end, said rear longitudinal portion consisting essentially of an outer end portion, a handle means mounted on said outer end portion, an elongated connecting portion connecting said outer end portion to said longitudinally intermediate portion of said base structure and a counterweight means operatively connected to said elongated connecting portion, said base structure having a use orientation in which it longitudinally extends along and is supported by the floor surface, with said rear longitudinal portion extending rearwardly between the support portions of the chair beneath its seat, and the balance of said base structure extending forwardly beyond the chair along the floor surface;

an elongated, upstanding force input lever pivotally connected at an inner end thereof to said longitudinally intermediate portion of said base structure for forward and rearward pivotal movement relative thereto, in a generally rowing-like fashion, about a horizontal axis generally transverse to the length of said base structure, said force input lever having an outer end portion to which handgrip means are secured that may be grasped by an exerciser sitting in the chair and pushed and pulled to respectively impart said forward and rearward pivotal movement to said force input lever;

elongated resistance means, having first and second opposite ends respectively connectable to said outer end of said front longitudinal portion of said base structure and to said force input lever, for yieldably resisting both said forward pivotal movement and said rearward pivotal movement of said force input lever relative to said base structure;

first connection means for pivotally securing said first end of said resistance means to said outer end of said front longitudinal portion of said base structure;

second connection means for pivotally securing said second end of said resistance means to said force input lever, said second connection means being movable along the length of said force input lever and having first locking means associated therewith and operative to releasably lock said second connection means to a selectively variable location on said force input lever to thereby permit the pivotal resistance force imposed upon said force input lever by said resistance means to be selectively varied;

footrest means, supported on said front longitudinal portion of said base structure for forward and rearward movement along its length, for supporting the feet of the seated exerciser;

second locking means for releasably locking said footrest means to a selectively variable longitudinal portion of said front longitudinal portion of said base structure to thereby provide said exercise apparatus with a convenient exerciser leg length adjustment;

rolling support means, secured to said outer end of said front longitudinal portion of said base structure, for rollingly supporting said outer end of said front longitudinal portion of the floor surface when said base structure is forwardly and upwardly tipped, said rolling support means being spaced upwardly apart from the floor surface when said base structure is in its use orientation;

said carrying handle means being associated with said outer end portion of said rear longitudinal portion of said base structure and liftable to forwardly and upwardly pivot said base structure to thereby operatively engage said rolling support means with the floor surface to permit said exercise apparatus to be easily rolled therealong to and from a storage location;

frictional gripping means, carried by front and rear underside portions of said base structure for frictionally engaging the floor surface and inhibiting movement of said base structure therealong during operation of said exercise device; and said counterweight means, being operatively connected to said rear longitudinal connecting portion of said base structure, for inhibiting forward and upward tipping of said base structure during forward pivotal motion of said force input lever relative to said base structure with said base structure in its use orientation.

11. The exercise apparatus of claim 10 wherein:

said rolling support means are positioned on said base structure to operatively engage the floor surface when said base structure is forwardly and upwardly tipped at a small angle relative to horizontal.

12. The exercise apparatus of claim 11 wherein: said small angle is approximately 15°.

13. The exercise apparatus of claim 10 wherein: said elongated force input lever has a longitudinally intermediate portion forwardly bent relative to said inner end portion of said force input lever, and said outer end portion of said force input lever is forwardly bent relative to said longitudinally intermediate portion of said force input lever, and said second connection means are movably secured to said longitudinally intermediate portion of said force input lever.

14. The exercise apparatus of claim 10 wherein:

said force input lever is forwardly pivotable relative to said base structure to a compact storage orientation in which said outer end portion of said force input lever is closely adjacent said outer end of said front longitudinal portion of said base structure.

* * * * *